US012214272B2

(12) United States Patent
Pollokhin et al.

(10) Patent No.: US 12,214,272 B2
(45) Date of Patent: Feb. 4, 2025

(54) METHOD FOR GENERATING POSITION SIGNALS WHILE USING A VIRTUAL REALITY HEADSET

(71) Applicant: VR Simulations, Inc., New York, NY (US)

(72) Inventors: Ilya Pollokhin, New York, NY (US); Nan Lin Wen, New York, NY (US); Mikhail Zhavoronkov, Northville, MI (US)

( * ) Notice: Subject to any disclaimer, the term of this patent is extended or adjusted under 35 U.S.C. 154(b) by 225 days.

(21) Appl. No.: 17/664,356

(22) Filed: May 20, 2022

(65) Prior Publication Data

US 2022/0370883 A1 Nov. 24, 2022

Related U.S. Application Data

(60) Provisional application No. 63/190,848, filed on May 20, 2021.

(51) Int. Cl.
*A63B 71/06* (2006.01)
*A63B 24/00* (2006.01)

(52) U.S. Cl.
CPC ..... *A63B 71/0622* (2013.01); *A63B 24/0087* (2013.01); *A63B 2024/0096* (2013.01); *A63B 2071/0627* (2013.01); *A63B 2071/0638* (2013.01); *A63B 2071/0666* (2013.01); *A63B 2220/10* (2013.01); *A63B 2220/836* (2013.01)

(58) Field of Classification Search
CPC ..... A63B 24/0087; A63B 71/0622; A63B 2024/0096; A63B 2071/0081; A63B 2071/0627; A63B 2071/0638; A63B 2071/0666; A63B 2071/068; A63B 2220/10; A63B 2220/40; A63B 2220/806; A63B 2220/836
See application file for complete search history.

(56) References Cited

U.S. PATENT DOCUMENTS

| | | | | |
|---|---|---|---|---|
| 10,864,407 | B2 | 12/2020 | Watterson | |
| 2019/0143173 | A1 | 5/2019 | Fung | |
| 2020/0376339 | A1 | 12/2020 | Chu | |
| 2022/0269334 | A1 | 8/2022 | Savci | |
| 2022/0370883 | A1* | 11/2022 | Pollokhin | A63B 71/0622 |
| 2023/0226434 | A1* | 7/2023 | Pollokhin | A63B 71/0622 482/8 |
| 2023/0249048 | A1* | 8/2023 | Pollokhin | G06T 15/10 482/4 |

OTHER PUBLICATIONS

ISR of PCT/US22/72485, mailed Aug. 10, 2022.

* cited by examiner

*Primary Examiner* — Megan Anderson
(74) *Attorney, Agent, or Firm* — Simonelli IP, PLLC

(57) ABSTRACT

A method controls a piece of exercise equipment when a user of the exercise equipment is using a virtual reality headset. The method begins by receiving sensor inputs detecting a position of the user with respect to the exercise equipment. An operational zone of the exercise equipment is then determined. It is then identified when the user is moving toward a warning area within the operational zone of the exercise equipment. The method then sends signals to the virtual reality headset. Based on the signals, the virtual reality headset creates audible and visual outputs to instruct the user to move back fully into the operational zone of the exercise equipment.

12 Claims, 5 Drawing Sheets

METHOD FOR GENERATING POSITION SIGNALS WHILE USING A VIRTUAL REALITY HEADSET

BACKGROUND ART

Field of the Invention

The invention relates to a method for generating a position signal to a person using an extended reality headset. More particularly, the invention relates to a method for generating a warning when a person using an extended reality headset moves away from a desired position.

Description of the Related Art

Screen technology has enabled users to view screens while performing certain functions, from playing games, to driving vehicles, to exercising. When exercising, viewing a panoramic view may motivate or inspire the user to continue exercising. In other instances, the view of the screen may be programmed into the exercise equipment being used to mimic the conditions on the screen. For example, running up a hill on the screen may be coordinated with the treadmill increasing its incline.

However, a screen can only be so immersive. A virtual reality headset (XRH) is more immersive in that it encompasses the entire view of the user. And while use of an XRH may be more immersive, a user will have issues with an actual frame of reference in which the user is being active, especially since the actual real-world environment may not be visible while wearing an XRH.

SUMMARY OF THE INVENTION

A method controls a piece of exercise equipment when a user of the exercise equipment is using an extended reality headset. The method begins by receiving sensor inputs detecting a position of the user with respect to the exercise equipment. Once the inputs are received, an operational zone of the exercise equipment is then determined. Sensor inputs are used to detect a position of the user with respect to the piece of exercise equipment.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
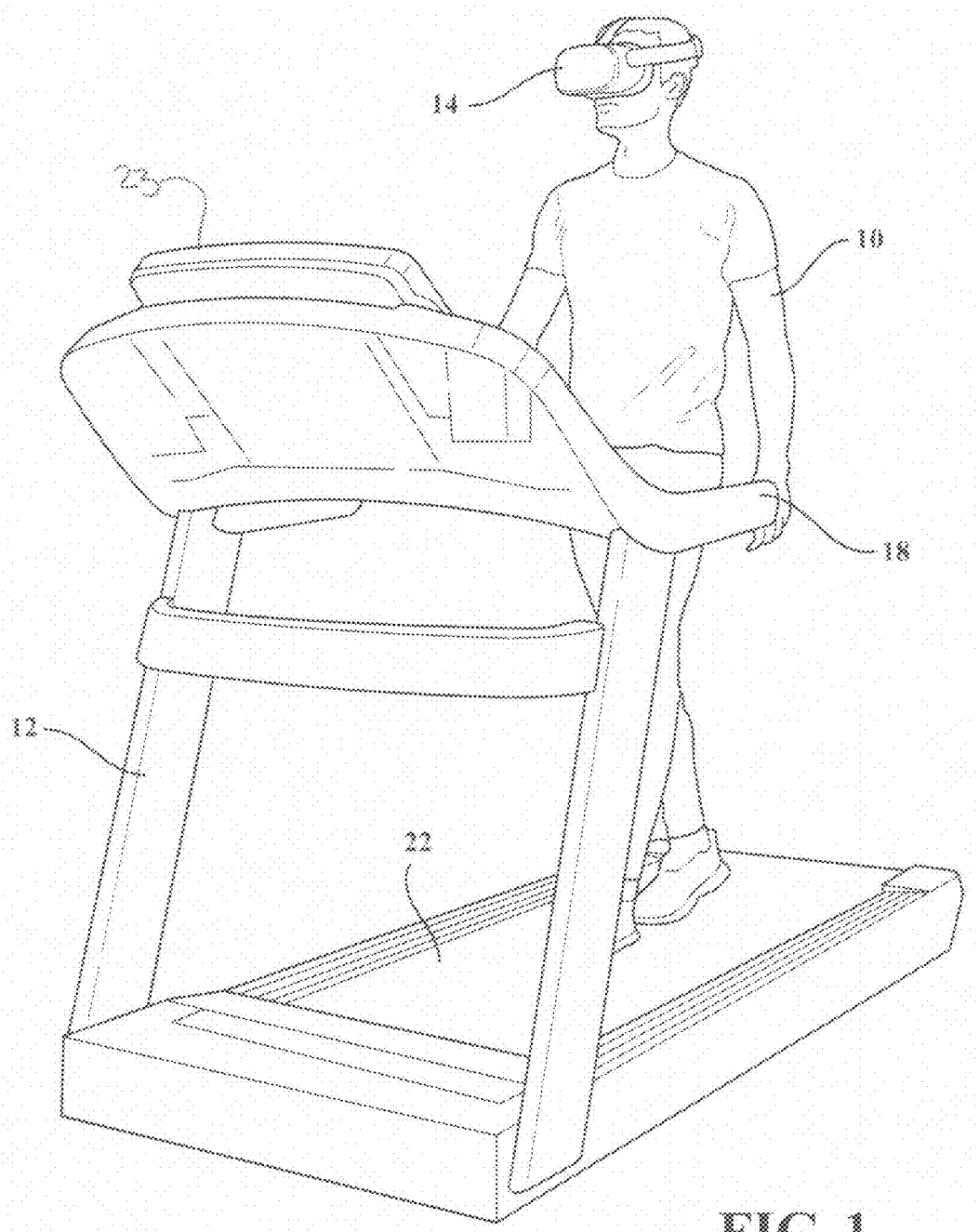
FIG. 1 is a perspective view of a user wearing an XRH.

Referring to FIG. 1, a user 10 is operating a piece of exercise equipment 12 while wearing an XRH 14. While it is contemplated that any piece of exercise equipment may be used with the XRH 14 and the method described hereinbelow, the piece of exercise equipment 12 shown is a treadmill.

Figure 2:
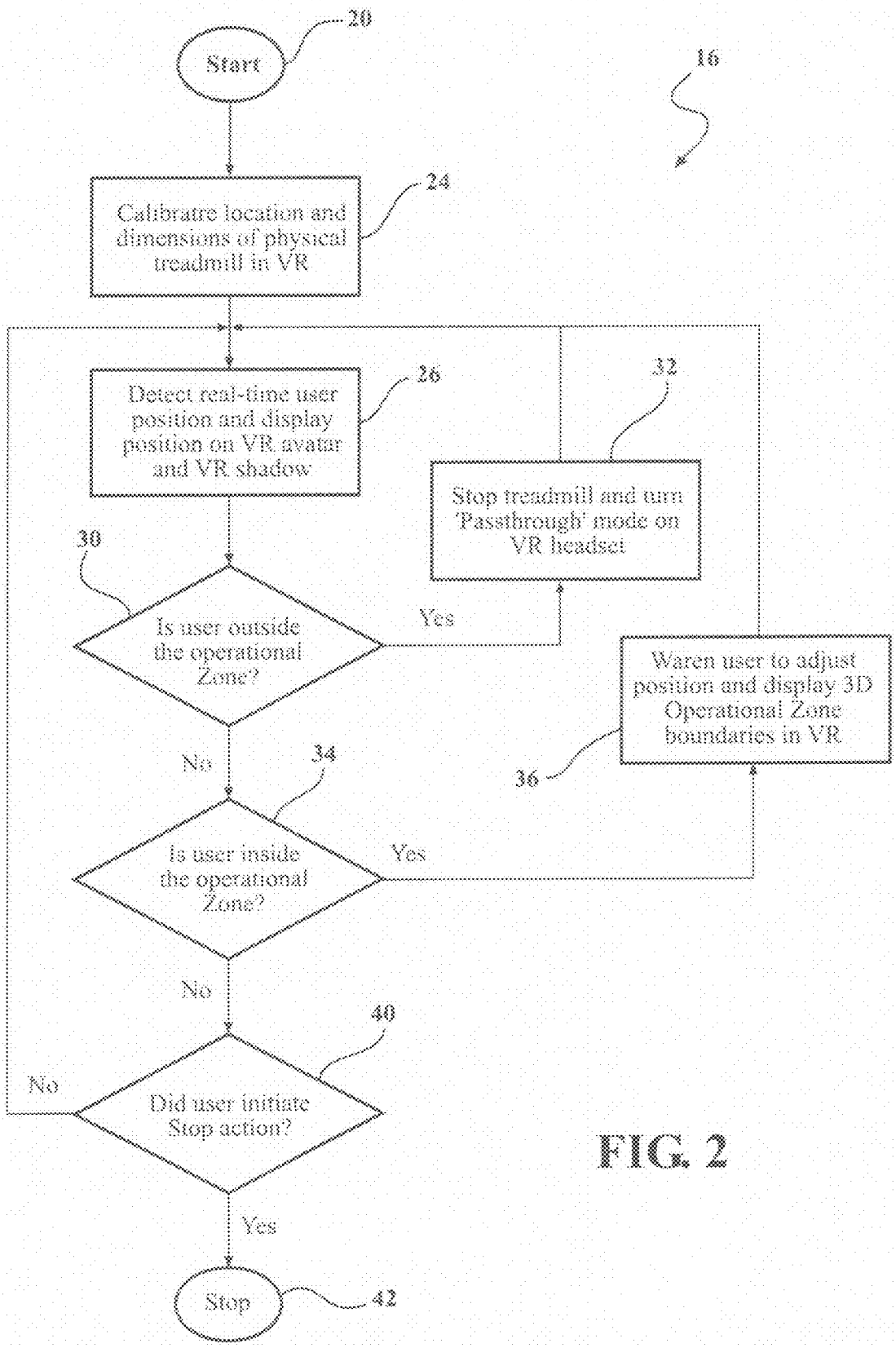
FIG. 2 is logic chart of one embodiment of the method.

A logic chart of a method to guide the user 10 in his or her use of the treadmill 12 while wearing the XRH 14 is generally shown at 16 in FIG. 2. The method begins at 20.

The location, orientation, and dimensions of a user operating space 22 is calibrated at 24. In the embodiment shown, the user operating space 22 is the treadmill running surface. The treadmill 12 includes a set of handrails 18 that the user 10 may grab ahold of should the user 10 need to balance or steady himself/herself. The treadmill 12 also includes a control panel 23 (the back of which is shown in FIG. 1) that may also be used in the step of calibration 24.

Once calibrated, the method 16 begins to detect where the user 10 is in space with respect to the treadmill running surface 22. The method 16 does this at 26. The position of the user 10 is defined relative to some defined point in the real world by identifying defined "immovable" objects in relation to the treadmill running surface 22. This is done similar to how a virtual reality headset would scale a room in which the headset is being used. With the XRH 14, the set of handrails 18 and the control panel 23 may be used. As long as the parameters of the treadmill 12 (belt position) and the direction of the user 10 with respect to the center of the treadmill 12 are known, the calibration step 24 can be completed. Detection is on the order of millimeters. Cameras and accelerometers in the XRH 14 are used to detect position. The XRH 14 tracks forces and magnetic fields, direction of motion, all of which are augmented by the camera(s) in the XRH 14 (none shown).

At the same time the location of the user 10 is determined, the method displays an avatar 44 of the user 10 in the XRH 14 (the avatar 44 will be discussed in greater detail below). The method also creates a VR shadow 28 in step 26. The VR shadow 28 is graphically represented by a diamond in FIG. 5. The VR shadow 28 is not a real shadow, but an image, such as a diamond or an "X" and the like. The VR shadow 28 is visible when the user 10 looks directly at his or her feet. When the XRH 14 is pointed downwardly, the VR shadow 28 is rendered over the actual treadmill running track 22 to assist the user 10 in positioning themselves in the middle of the treadmill running track 22.

Figure 3:
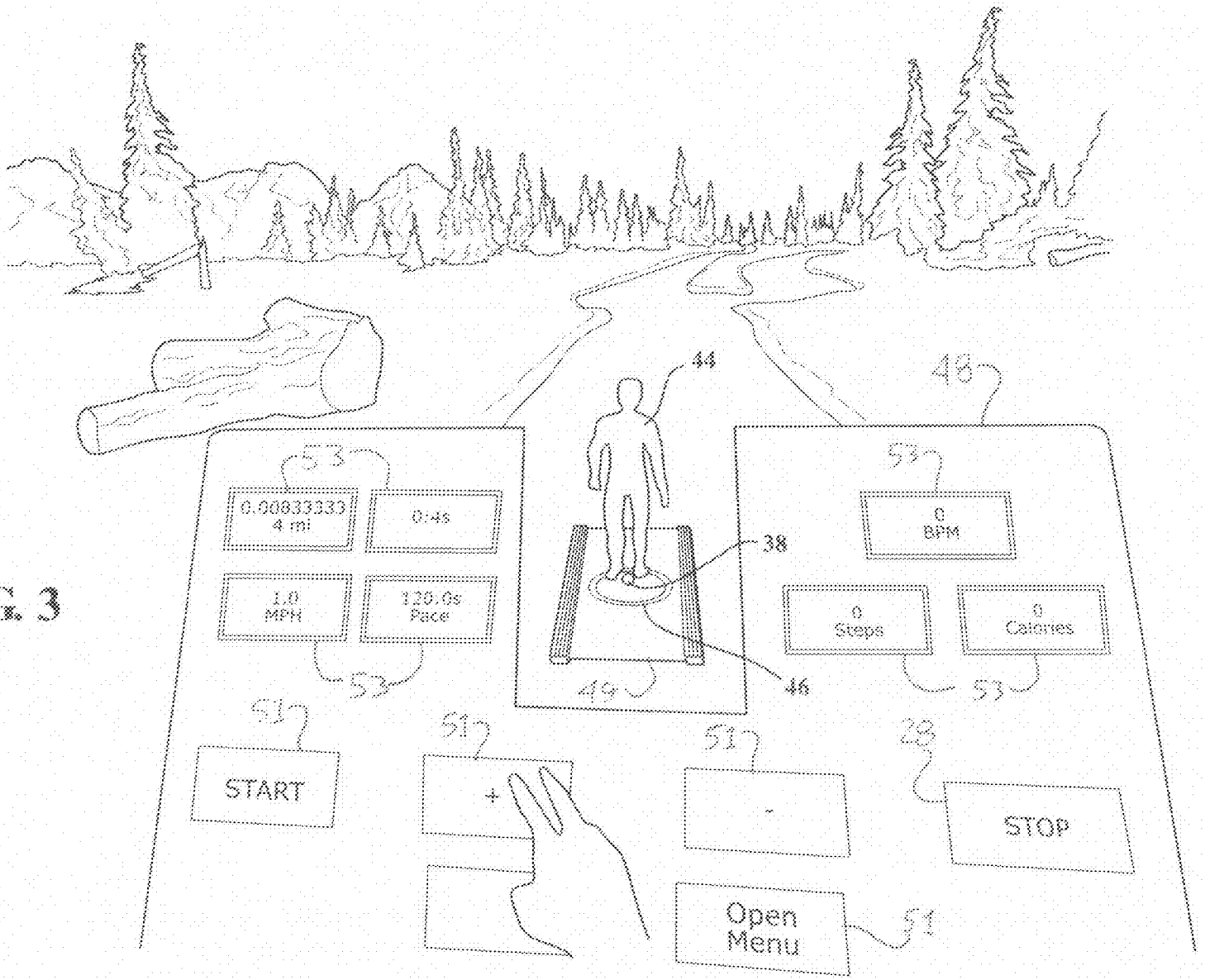
FIGS. 3 through 5 are graphic representations of what a user sees when using the method.
Figure 5:
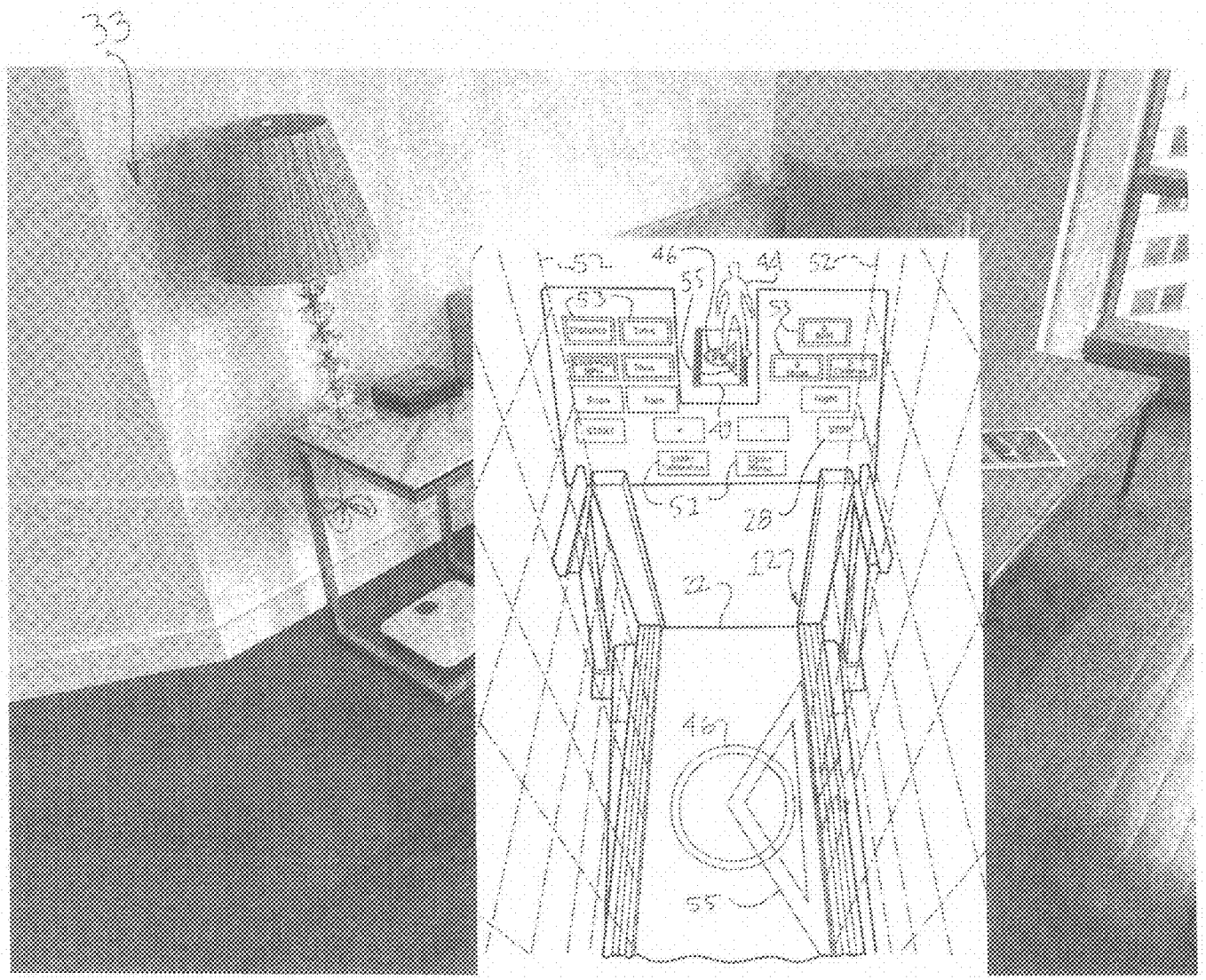

The avatar 44 is shown as a human figure in FIG. 3. The avatar shadow 38 and the VR shadow 28 in FIG. 5 are shown as a circle/diamond for representation purposes only. The avatar 44, the avatar shadow 38, and the VR shadow 28 can be any other graphic representation (circle, sphere, dot, etc.) of the user 10 and its shadow (not shown).

Once the user 10 is located, the method 16 determines whether the user 10 is inside, moving toward or outside an operational zone at 30 (the operational zone is discussed in greater detail subsequently). It does this by providing a signal to the XRH 14 at any given moment during the use of the XRH 14. If it is determined that the user is outside the operational zone, the method 16 enters the emergency operational mode at 32. In the emergency operational mode, the method may send control signals to the treadmill 12 to slow or stop the treadmill 12. In addition, the method 16 may also have the XRH 14 enter into pass through mode allowing the user 10 to see the physical treadmill 12, its handrails 18, and the room 33 in which the treadmill 12 is to allow the user 10 to orient with respect to these objects and the space. This is accomplished when a signal to the XRH 14 when outside the operational zone 46. If the method 16 determines an alternative to stopping is more appropriate, such as reducing the incline of the treadmill running surface 22 or merely slowing it down, the method 16 will send command signal to the treadmill 12 for the appropriate action. Once the method 16 completes the action based on the user 10 being outside the operational zone, the method 16 loops back and returns to the step of detecting the location of the user 10 at 26.

Returning attention to the decision at 30, if the user is in the operational zone, the method 16 detects whether the user 10 is in the warning zone of the operational zone at 34. The warning zone is a subset of the operational zone and the method 16 does not take the same measures as if the user 10 was outside the operational zone. However, if the user is inside the warning zone, it warns the user 10 through appropriate means at 36, by sending a signal to the XRH 14, and moves the avatar 44 and an avatar shadow 38 to represent the position of the user 10. The avatar 44 is a graphic representation of the user 10 and the avatar shadow 38 is an indicator of the position of the avatar 44 on the treadmill running surface 22. One, the other or both may be used by the method, possibly depending on a preference setting made by the user 10. The avatar shadow 38 may be a circle (as shown in FIG. 3) or it may be simply a mark, such as an "X." Once the identification of the user 10 entering the warning zone occurs, a signal is sent to the XRH 14 and the method 16 loops back and continues to detect the location of the user 10 at 26.

If the user 10 is not in the warning zone, it is determined at 40 whether the user 10 should initiate a stop sequence (voice activated or virtual stop button). Pressing a virtual stop button 28 created by the XRH 14 will provide a command to the treadmill 12 that it's stop button has been pressed. If not, the method 16 loops back and continues to monitor the location of the user 10 at 26. If the button has been pressed, the method 16 and treadmill 12 stop at 42.

Figure 4:
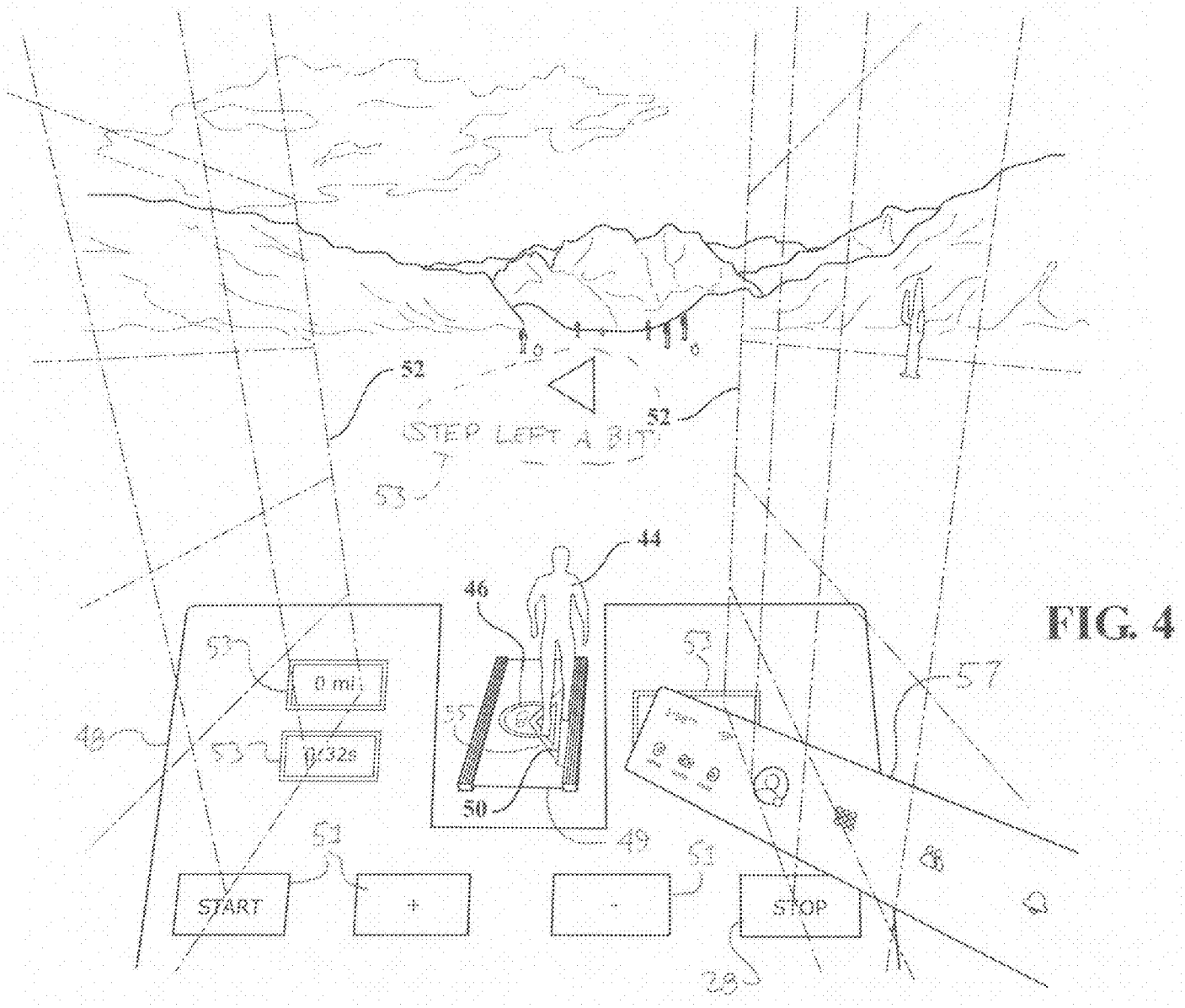

FIG. 3 shows the avatar 44 of the user 10 on the screen with the avatar 44 standing in the operational zone, depicted by circles 46, which are shown on a graphic representation of a virtual treadmill running surface 49. The avatar 44 is partially surrounded by a virtual control panel 48, that includes multiple control buttons 51, including the stop button 28. Performance and status information are also provided with portions 53 of the virtual control panel 48. (Portions 57 of the virtual control panel 48 may be oriented and/or positioned away from the virtual control panel, as is shown in FIG. 4.) The avatar shadow 38 graphically represents the position of the avatar 44, and hence the user 10, in relation to the operational zone 46 in which the center of the avatar 44 resides, as viewed from a bird's eye view. The avatar 44 and the avatar shadow 38 passively helps identify precise location of the user 10 and whether the user 10 needs to adjust himself/herself with respect to the actual treadmill 12. These are passive indicators helping the user 10 identify where he or she is with respect to the treadmill 12. The use of the avatar 44 and the avatar shadow 38 help the user 10 know what corrective action is needed in order to maintain control of his or her exercise.

FIG. 4 shows the avatar 44 entering the warning zone, represented by a lateral edge zone 50 on the treadmill 12. Two side grids 52 appear in order to help the user 10 move back into the operational zone 46 and out of the warning zone 50 of the operational zone 46. The method 16 also provides suggestion in the form of visual messages 53 that appear on the screen. By way of example, FIG. 4 illustrates the graphic messages 53 to include a "step left a bit" and a directional arrow. These also help the user 10 know which way to reposition himself/herself for continued use in the operational zone 46. Additionally, a graphic arrow 55 may be shown on the graphic representation of the treadmill running surface 22. It should be appreciated by those skilled in the art that the suggestions and messages provided to the user 10 may escalate as time goes on or as the user 10 moves further into the warning zone 50.

FIG. 5 shows the view of user 10 stepping outside the operational zone 46, requiring the method to actively control the treadmill 12, either by slowing it down, decreasing its incline or stopping it completely. In this Figure, the virtual elements are shown along with the actual treadmill 12 and the treadmill running surface 22 with virtual elements superimposed on the real-world elements. This is because the XRH 14 is switched to passthrough mode to show the surrounding environment of the user 10 to help user orient in his/her physical space. More specifically, the XRH 14 allows the user 10 to see the room 33. FIG. 5 includes virtual representations of the control panel, the handrails 18, and the treadmill running surface 22. These can be used by the user 10 to orient himself/herself based because those will be fixed in a defined orientation and will allow the user 10 to correct positioning with respect to the treadmill 12.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

We claim:

1. A method for controlling exercise equipment when a user of the exercise equipment is using an extended reality headset, the method comprising the steps of:

identifying a position and orientation of the exercise equipment by viewing the exercise equipment through the extended reality headset;

sensing a position of the user with respect to the exercise equipment by identifying a location and orientation of the extended reality headset with respect to the position and orientation of the exercise equipment; and controlling the output of the exercise equipment using the extended reality headset.

2. A method as set forth in claim 1 including the step of determining an operational zone of the exercise equipment in which the user is to use the exercise equipment.

3. A method as set forth in claim 2 including the step of identifying when the user is moving toward a warning zone disposed adjacent the operational zone.

4. A method as set forth in claim 3 wherein the step of receiving sensor inputs detecting the position of the user with respect to the exercise equipment is continuous during use of the exercise equipment by the user.

5. A method as set forth in claim 4 including the step of identifying when the user is at the warning zone.

6. A method as set forth in claim 5 including the step of sending a signal to the exercise equipment to instruct the exercise equipment to alter the output of the exercise equipment.

7. A method as set forth in claim 6 wherein the step of sending signals to the exercise equipment is continuous during use of the exercise equipment by the user.

8. A method as set forth in claim 2 including the step of identifying when the user is outside the operational zone of the exercise equipment.

9. A method for controlling exercise equipment when a user of the exercise equipment is using an extended reality headset, the method comprising the steps of:

identifying a position and orientation of the exercise equipment by viewing the exercise equipment through the extended reality headset;

sensing a position of the user with respect to the exercise equipment by identifying a location and orientation of the extended reality headset with respect to the position and orientation of the exercise equipment; and determining an operational zone of the exercise equipment;

identifying when the user is outside the operational zone of the exercise equipment; and providing instructions to the exercise equipment to limit activity of the exercise equipment when the user is outside the operational zone.

10. A method as set forth in claim 9 including the step of controlling the extended reality headset when the user moves outside the operational zone of the exercise equipment.

11. A method as set forth in claim 10 wherein the step of sending signals to the extended reality headset is continuous during use of the exercise equipment by the user.

12. A method as set forth in claim 11 including the step of sending signals to the extended reality headset and to the exercise equipment continuously during use of the exercise equipment by the user.

* * * * *